US009429870B2

(12) United States Patent
Anderson et al.

(10) Patent No.: US 9,429,870 B2
(45) Date of Patent: Aug. 30, 2016

(54) SYSTEM AND METHOD FOR MAGNETIC COMMUNICATION BETWEEN REPLACEABLE UNIT AND IMAGING DEVICE

(71) Applicant: Lexmark International, Inc., Lexington, KY (US)

(72) Inventors: John Douglas Anderson, Lexington, KY (US); Christopher Michael Nelson, Lexington, KY (US); Brian Keith Owens, Lexington, KY (US); Adam Randal Wiedemann, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/537,069

(22) Filed: Nov. 10, 2014

(65) Prior Publication Data

US 2015/0362860 A1 Dec. 17, 2015

Related U.S. Application Data

(60) Provisional application No. 62/011,946, filed on Jun. 13, 2014.

(51) Int. Cl.
*G03G 15/08* (2006.01)

(52) U.S. Cl.
CPC ..... *G03G 15/0865* (2013.01); *G03G 15/0863* (2013.01); *G03G 15/0867* (2013.01)

(58) Field of Classification Search
CPC ..... G03G 15/0836; G03G 15/0863; G03G 2215/0695; G03G 2215/0697
See application file for complete search history.

(56) References Cited

U.S. PATENT DOCUMENTS

| | | | |
|---|---|---|---|
| 6,343,883 | B1 | 2/2002 | Tada et al. |
| 7,231,153 | B2 | 6/2007 | May |
| 2014/0169806 | A1 | 6/2014 | Leemhuis et al. |
| 2014/0169807 | A1 | 6/2014 | Leemhuis et al. |
| 2014/0169808 | A1 | 6/2014 | Leemhuis et al. |
| 2014/0169810 | A1 | 6/2014 | Leemhuis et al. |

FOREIGN PATENT DOCUMENTS

JP 2007192852 A * 8/2007

* cited by examiner

*Primary Examiner* — Erika J Villaluna

(57) ABSTRACT

An apparatus includes a housing having a reservoir for storing consumable material and an outlet for exiting the consumable material from the reservoir; a rotatable shaft disposed inside the reservoir and positioned along a length of the housing; and one or more magnetic members disposed within the housing and coupled to the shaft so as to rotate therewith. The one or more magnetic members generate a magnetic field and when rotating indicate information about the replaceable unit. The information is based upon the presence or absence of the one or more magnetic members relative to one or more predetermined locations for receiving a magnetic member within the housing.

21 Claims, 6 Drawing Sheets

SYSTEM AND METHOD FOR MAGNETIC COMMUNICATION BETWEEN REPLACEABLE UNIT AND IMAGING DEVICE

CROSS REFERENCES TO RELATED APPLICATIONS

The present application claims priority under 35 U.S.C. 119(e) from U.S. provisional application No. 62/011,946, filed Jun. 13, 2014, entitled, "System and Method for Magnetic Communication between Toner Bottle and Imaging Device," the content of which is hereby incorporated by reference herein in its entirety.

BACKGROUND

1. Field of the Invention

The present invention relates generally to image forming devices and more particularly to a replaceable unit of an image forming device and communication therebetween.

2. Description of the Related Art

In electrophotographic image forming devices, one or more replaceable units may be used to supply consumable material to the device upon installation of the replaceable unit(s) therein. Generally, a replaceable unit communicates with an image forming device certain information for proper operation. In particular, the replaceable unit communicates with the image forming device its country of origin (perhaps for its authentication), geographical location of shipment, its stored consumable material, and/or other settings/information associated with the replaceable unit. This information is often stored in or on the replaceable unit upon its manufacture but some of the information, such as the shipping location, could be changed thereafter in order to adapt to customer demand.

Typically, replaceable unit have a housing forming a reservoir for consumable material and often include consumable material agitators or paddles in the reservoir to fluff and mix consumable material in the reservoir, thereby preventing consumable material from clumping. Agitators and paddles also direct consumable material to an exit port for supplying consumable material to a developer unit of the image forming device. An existing replaceable unit 10 is generally shown in FIG. 1. Replaceable unit 10 has a cylindrically-shaped housing 12 and includes a shaft 14 within a reservoir 13 formed by the housing 12. A molded paddle assembly 16 having paddles A, B, C, D in reservoir 13 is mounted on shaft 14 to agitate and move toner in reservoir 13 toward an outlet of housing 12 as shaft 14 rotates. With replaceable unit 10 in an image forming device, information associated with replaceable unit 10 is communicated to the imaging device using, for example, relatively expensive smart chips and/or memory devices that are mounted on housing 12. With the bottle design of FIG. 1 and other similar designs, these information-storing devices mounted on the bottle housing can be tampered with, hacked or copied.

SUMMARY OF THE INVENTION

There is disclosed an apparatus for supplying consumable material, including a housing having a reservoir for storing the consumable material. The housing has an outlet for exiting consumable material from the reservoir. A rotatable shaft is disposed inside the reservoir and positioned along a length of the housing. One or more magnetic members are coupled to the shaft so as to rotate with the shaft. The one or more magnetic members generate a magnetic field and when rotating, conveys information about the apparatus. In the example embodiment, the information is based upon the presence or absence of the one or more magnetic members relative to one or more predetermined locations for receiving a magnetic member within the apparatus.

In one example embodiment, the one or more predetermined locations for receiving the one or more magnetic members may be angularly displaced from each other about the shaft or from a home position thereof. In addition or in the alternative, the one or more predetermined locations may be spaced from each other in a direction corresponding to a longitudinal axis of the shaft. In addition, the one or more predetermined locations may be spaced from each other in a radial direction of the shaft. This angular, axial and/or radial spacing affects the magnetic field generated by the one or more magnetic members such that the information conveyed is based at least in part upon the spacing.

In another example embodiment, the apparatus includes at least one disk member coupled to the shaft and to which the one or more magnetic members are mounted. In still another example embodiment, the disk member and magnetic members coupled thereto are located in and form part of an end cap assembly. In this way, the one or more magnetic members are separated from the reservoir and the consumable material therein.

In an example embodiment, the apparatus includes an image forming device having one or more magnetic sensors for sensing the magnetic field. The housing, shaft, and magnetic members form at least part of a replaceable unit removably insertable into the image forming device.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
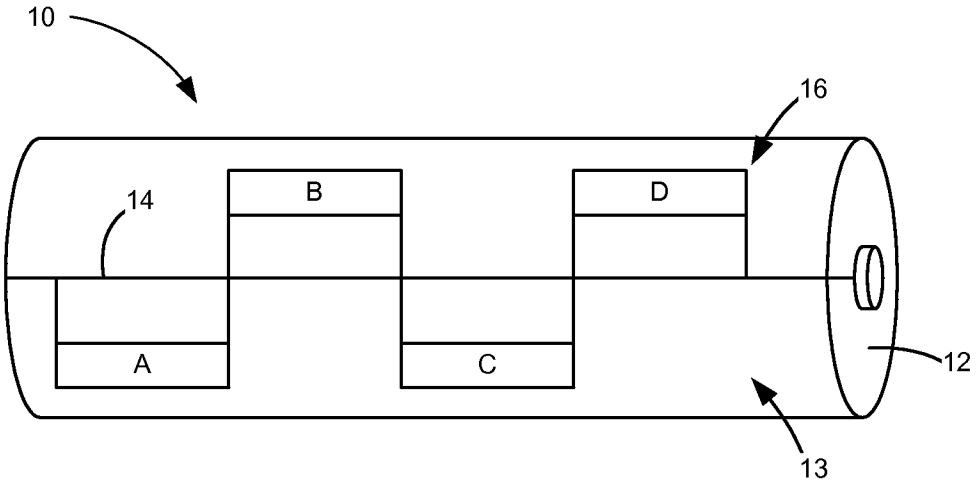
Figure 1 (Prior Art)
FIG. 1 is a side perspective view of a known replaceable unit showing a consumable material delivery mechanism therein.

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Reference will now be made in detail to the example embodiments, as illustrated in the accompanying drawings. Whenever possible, the same reference numerals will be used throughout the drawings to refer to the same or like parts.

Figure 2:
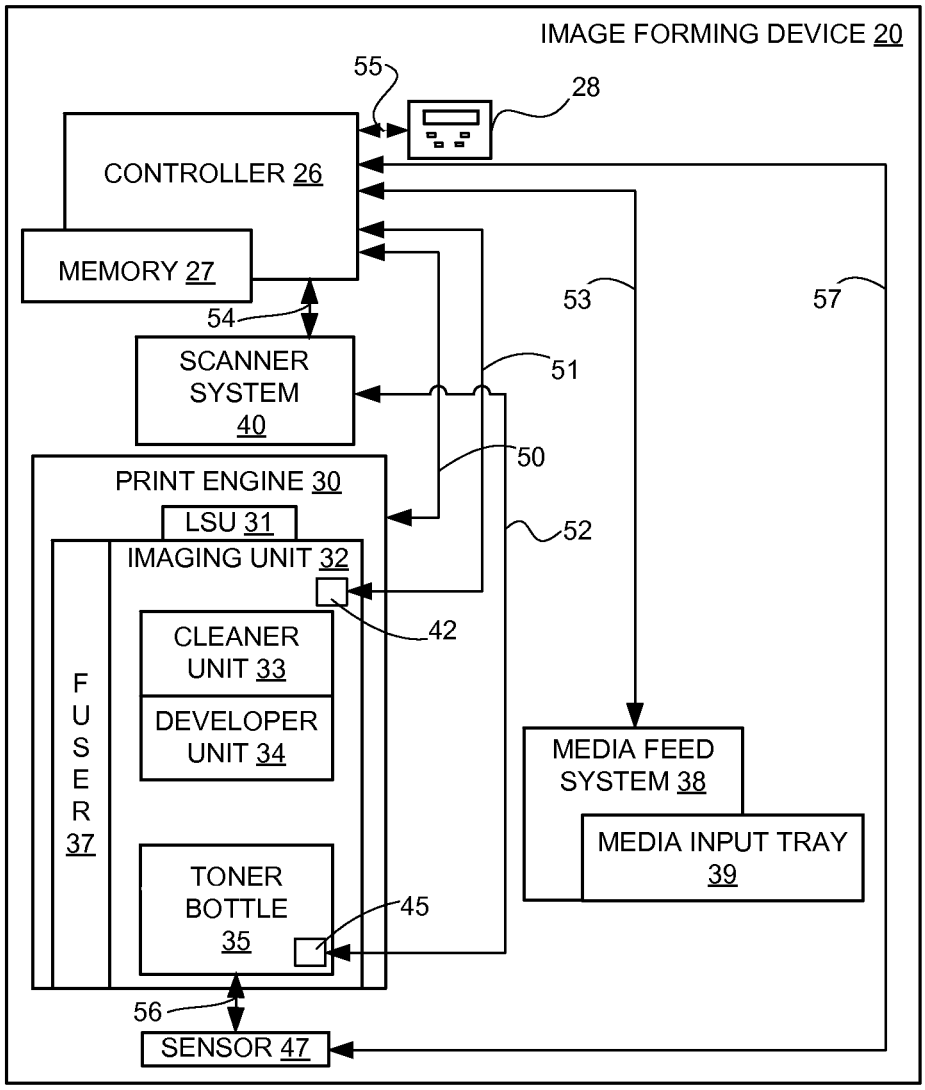
FIG. 2 is a block diagram of an image forming device according to one example embodiment.

Referring to the drawings and particularly to FIG. 2, there is shown a block diagram depiction of an image forming device 20. In the example embodiment shown in FIG. 2, image forming device 20 is a multifunction product (sometimes referred to as an all-in-one (AIO) device) that includes a controller 26, a user interface 28, a print engine 30, a laser scan unit (LSU) 31, and one or more imaging units 32, each having a cleaner unit 33, a developer unit 34 and one or more toner cartridges or bottles 35. Image forming device 20 also includes a fuser 37, a media feed system 38 and a media input tray 39, and a scanner system 40. Image forming device 20 may communicate with a computer via a standard communication protocol, such as, for example, universal serial bus (USB), Ethernet or a wireless connection such as Wi-Fi, using a communications link. As used herein, "communications link" generally refers to any structure that facilitates electronic communication between multiple components and may operate using wired/wireless technology, such as communications over the Internet. Image forming device 20 may be, for example, an electrophotographic (EP) printer/copier with an integrated scanner system 40 or a standalone EP printer.

Controller 26 processes print and scan data and operates print engine 30 during printing and scanner system 40 during scanning Controller 26 includes a processor unit and associated memory 27 and may be formed as one or more Application Specific Integrated Circuits (ASICs). Memory 27 may be any volatile or non-volatile memory or combination thereof such as, for example, random access memory (RAM), read only memory (ROM), flash memory and/or non-volatile RAM (NVRAM). Alternatively, memory 27 may be in the form of a separate electronic memory (e.g. RAM, ROM, and/or NVRAM), a hard drive, a CD or DVD drive, or any memory device convenient for use with controller 26. Controller 26 may be, for example, a combined printer and scanner controller.

In the example embodiment illustrated, controller 26 communicates with print engine 30, LSU 31 and fuser 37 via communications links 50. Controller 26 communicates with imaging unit(s) 32 and processing circuitry 42 on each imaging unit 32 via communications link(s) 51. Controller 26 communicates with toner bottle(s) 35 and processing circuitry 45 on each toner bottle 35 via communications link(s) 52. Controller 26 communicates with media feed system 38 via a communications link 53. Controller 26 communicates with scanner system 40 via a communications link 54. User interface 28 is communicatively coupled to controller 26 via a communications link 55. Processing circuitry 42, 45 may include a processor, associated memory such as RAM, ROM, and/or NVRAM and may provide authentication functions, safety and operational interlocks, operating parameters and usage information related to imaging unit(s) 32 and toner bottle(s) 35, respectively.

In the embodiment illustrated, image forming device 20 includes one or more sensors 47 mounted thereon. Toner bottle 35 communicates with one or more sensors 47 via a magnetic communications link 56, in particular using magnetic fields emanating from one or more magnets disposed on or in each toner bottle 35. Sensor(s) 47 communicate with controller 26 via a communications link 57. Sensors 47 may be Hall Effect sensors for detecting magnetic field strength(s) from magnetic field lines extending through a space or air gap between toner bottle 35 and sensors 47, but it is understood that the one or more sensors 47 may be other types of sensors that are capable of sensing the presence and strength of a magnetic field in its proximity Sensors 47 may operate in low power modes where sensors 47 turn on and off quickly for active sensing of magnetic field strength in a short time window. In one example embodiment, the short time window can be chosen to occur at a time when communication links with controller 26 are inactive or less active such as, for example, while print engine 30 sits idle during a scan operation performed by scanner system 40.

Using sensor(s) 47, controller 26 samples or otherwise collects measurements of the magnetic field generated by toner bottle 35 and processes the collected measurements. In particular, the processing may include determining, decoding or otherwise extracting information relating to toner bottle 35 from the collected measurements. Image forming device 20 may use this information, for example, to verify that a correct toner bottle 35 with a particular consumable material color/type is installed, or the toner bottle 35 is used in the correct geographical area. Use of magnets in or on toner bottles 35 and sensors 47 in image forming device 20 allows each toner bottle 35 to convey, and image forming device 20 to receive, information regarding toner bottle 35 without the use of expensive smart chips and other memory therein. The manner in which the information is provided in the magnetic field will be described in greater detail below.

Figure 3:
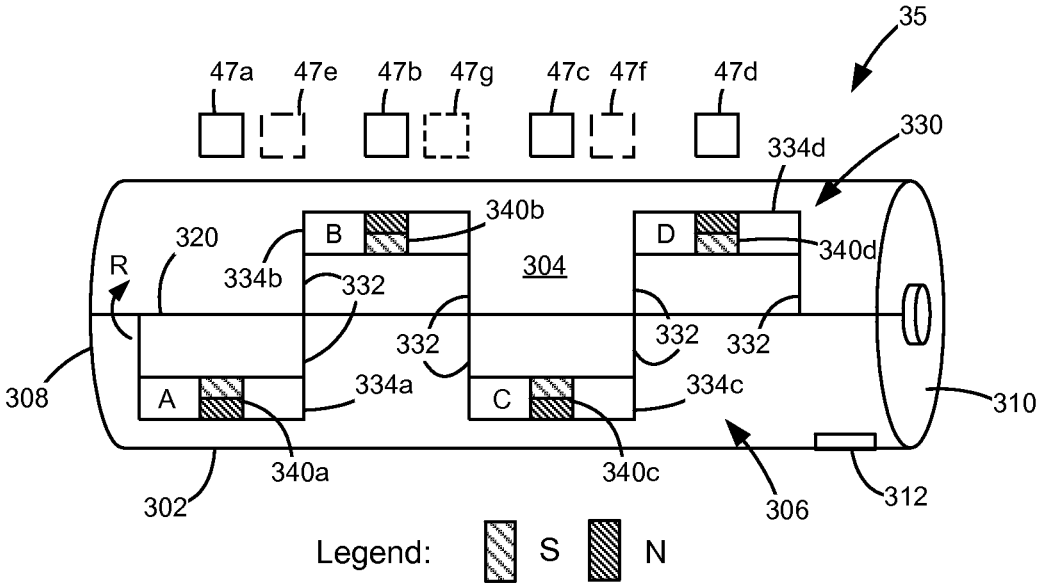
FIG. 3 is a perspective view of interior components of a replaceable unit and sensors of the image forming device of FIG. 2 according to one example embodiment.

FIG. 3 shows interior components of toner bottle 35 and sensors 47 of image forming device 20 according to one example embodiment. Sensors 47 are each spaced from toner bottle 35 when toner bottle 35 is in its installed position in image forming device 20. In the example embodiment illustrated, toner bottle 35 includes an elongated housing 302 that has an interior wall 304 forming a reservoir 306 for storing consumable material. As shown, housing 302 has a generally cylindrical shape and extends along a lengthwise dimension of toner bottle 35 to define a front end 308 and a rear end 310 of toner bottle 35. It is understood that housing 302 may have a shape other than a generally cylindrical shape. Rear end 310 is first to engage with image forming device 20 upon installation of toner bottle 35 therein. An outlet port 312 may be positioned at a bottom of housing 302 near rear end 310 for supplying consumable material, in this case toner, to imaging unit 32 in image forming device 20. In particular, consumable material is periodically delivered from reservoir 306 through the outlet port to an inlet port of a corresponding imaging unit 32 to refill a reservoir of imaging unit 32 as consumable material is consumed during the EP printing process. As desired, outlet port 312 may have a shutter or a cover (not shown) that is movable between a closed position blocking the outlet port and preventing consumable material from flowing out of toner bottle 35, and an open position permitting consumable material flow to the inlet port of imaging unit 32.

In the example embodiment shown in FIG. 3, a rotatable shaft 320 extends along the length of toner bottle 35 within reservoir 306. As desired, the ends of rotatable shaft 320 may be received in bushings or bearings located adjacent and/or coupled to front and rear ends 308, 310. A paddle assembly 330 is mounted on and rotatable with shaft 320 to stir and move consumable material within reservoir 306. In one embodiment, shaft 320 is composed of steel to handle high torque loads resulting from resistance to rotation of paddle assembly 330 due to consumable material in reservoir 306. This resistance is particularly high when toner bottle 35 is unused for a long period of time such as during shipping or storage which may cause the consumable material in reservoir 306 to pack. In an alternative embodiment, shaft 320 and the other components of toner bottle 35, such as interior components forming reservoir 306 are composed of rigid plastic or other non-magnetic material to have little to no effect on the magnetic fields used by toner bottle 35 to communicate with sensor(s) 47.

In the example embodiment illustrated in FIG. 3, paddle assembly 330 includes paddles A, B, C, and D mounted along shaft 320 from front end 308 to rear end 310. Each of paddles A, B, C, and D includes a pair of arms 332 extending radially from shaft 320 and toward interior wall 304. In the example embodiment shown in FIG. 3, the direction of radial extension from shaft 320 of pairs of arms 332 alternate by about 180 degrees along a length of shaft 320. Each paddle A-D further includes a crossbeam 334 disposed between a corresponding pair of arms 332 and positioned substantially near interior wall 304. Crossbeams 334*a*, 334*b*, 334*c* and 334*d* of paddles A, B, C and D, respectively, are consumable material-moving members that direct consumable material toward the outlet port. Although four (4) paddles A, B, C, D are shown, the number of paddles required may depend on a number of features and characteristics of toner bottle 35, including the angle of each crossbeam 334 relative to the longitudinal axis of shaft 320.

In this example embodiment, magnetic members 340*a*, 340*b*, 340*c*, 340*d* are coupled to shaft 320 so as to rotate therewith in, for example, a direction R. As illustrated in FIG. 3, magnetic members 340*a*, 340*b*, 340*c* and 340*d* are mounted on paddle assembly 330, specifically on crossbeams 334*a*, 334*b*, 334*c* and 334*d*, respectively. Magnetic members 340 may be made of a ferrite material or Neodymium, for example. Magnetic members 340 each generate a magnetic field that includes magnetic field lines propagating from a magnetic north (N) pole to a magnetic south (S) pole. By rotating magnetic members 340 relative to sensors 47, a toner bottle 35 is able to convey information about the toner bottle 35. This information may include, for example, consumable material type/color, shipment geography, country of origin (manufacture), and other characteristics regarding toner bottle 35.

The information collected by controller 26 may be based on an absence or a presence of a magnetic member(s) 340 on a corresponding paddle A-D. For example, in this embodiment, the absence of magnetic member 340*a* on paddle A at one sampling interval would indicate a binary 0 value while the presence of magnetic member 340*a* on paddle A in the same sampling interval would indicate a binary 1 value. In an example embodiment, up to two magnetic members 340 in toner bottle 35 may be used and assuming there are only two locations for the two magnetic members 340, two bits of information, corresponding to $2^2$ or four (4) possible combinations, are available for specifying information relating to toner bottle 35. With respect to FIG. 3, up to four magnetic members 340, and assuming there are only four possible locations therefor in toner bottle 35, a 4-bit digital signature is created having $2^4$ or 16 possible combinations for specifying information relating to toner bottle 35.

The above description for generating a 2-bit and a 4-bit digital signature assumes that there is only one possible location for each magnetic member 340 on paddles A-D or otherwise within toner bottle 35. It is further assumed that a suitable number of sensors 47 are used for detecting the presence or absence of each magnetic member 340. In an example embodiment of FIG. 3, each paddle A-D may hold no more than one magnetic member 340 and a sensor 47 may be employed in image forming device 20 for each paddle A-D. It is understood that the number of bits in the digital signature generated by magnetic members 340 may be increased by allowing for one or more magnetic members 340 to be placed in more than one possible location along a corresponding paddle A-D. Referring again to FIG. 3, in another example embodiment, each magnetic member 340 may be placed in any one of a plurality of positions along a corresponding paddle A-D. In this case, the positions may be center or any length left or right of the center along the corresponding paddle A-D, resulting in three possible locations for each magnetic member 340. Being able to position a magnetic member 340, and the ability to detect magnetic member 340, in any one of multiple locations along a corresponding paddle A-D, and thus located in a direction along the longitudinal axis of shaft 320, results in magnetic member 340 being able to be located closer or farther away from a corresponding sensor(s) 47, thereby providing the ability to further vary the magnetic field strength detected thereby. This ability to further vary the magnetic field strength detectable by sensor(s) 47 increases the size of the digital signature generated by toner bottle 35. With continued reference to FIG. 3, for toner bottle 35 having up to four magnetic members 340*a*-340*d*, image forming device 20 has four magnetic sensors 47*a*-47*d* so that a distinct sensor 47 is capable of reading the magnetic field contribution by the presence or absence of its corresponding magnetic member 340. In this case, each sensor 47 is positioned within image forming device 20 so that its corresponding magnetic member 340, if present, passes proximally thereto during a revolution of shaft 320. It is understood that a different number of sensors 47 may be utilized by image forming device 20 for sensing the magnetic field generated by magnetic members 340. For example, depending upon the sensitivity of sensors 47, a lesser number of sensors 47 may be utilized than the maximum number of magnetic members 340 in an effort to reduce the cost of image forming device 20. FIG. 3 also illustrates an embodiment in which only two sensors 47*e* and 47*f* are utilized, for detecting the magnetic field generated by the present or absence of magnetic members 340*a*-340*d*. Specifically, magnetic members 340*a*-340*d* are assumed to have substantially equal magnetic strength. Sensor 47*e*, which detects the presence/absence of magnetic members 340*a* and 340*b*, is offset from a central location between magnetic members 340*a* and 340*b* so that the magnetic field contribution from one magnetic member 340*a*-340*b* is distinguishable from the other. Similarly, sensor 47*f*, which detects the presence/absence of magnetic members 340*c* and 340*d*, is offset from a central location between magnetic members 340*c* and 340*d* so that the magnetic field contribution from one magnetic member 340*c*-340*d* is distinguishable from the other. In another alternative embodiment, a single sensor 47*g* (FIG. 3) may be employed to detect the presence/absence of each of magnetic members 340*a*-340*d*. Sensor 47*g* may be located relative to the predetermined locations for receiving magnetic members 340*a*-340*d* so that the distance to each magnetic member 340 location is unique. In this way, sensor 47*g* may be capable of distinguishing the contribution to the magnetic field by each magnetic member 340*a*-340*d*.

Figure 4:
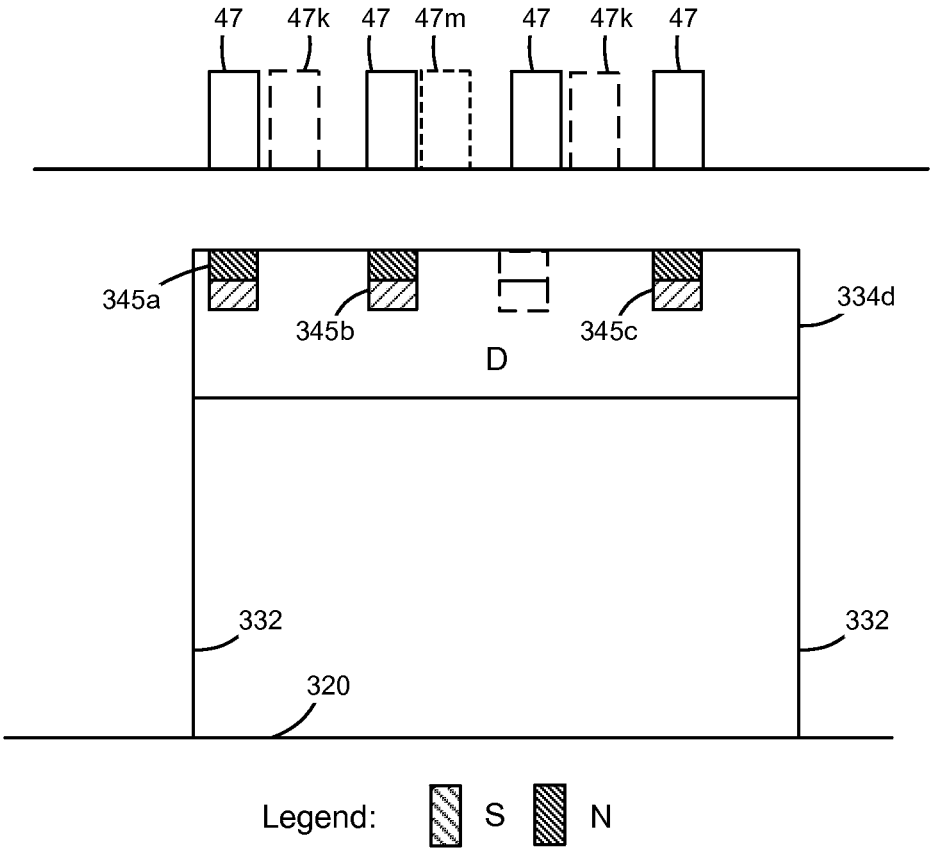
FIG. 4 is an elevational view of the sensors and a paddle assembly of a replaceable unit according to one example embodiment.

In another example embodiment illustrated in FIG. 4, more than one magnetic member 345 may be placed on the crossbeam 334 of each paddle A-D. Having multiple magnetic members 345 on a paddle allows for more variation in the magnetic field generated for detection by sensor(s) 47 and collection by controller 26, thereby further increasing the size of the digital signature of the generated magnetic field. As shown in FIG. 4, a paddle crossbeam 334 includes four locations disposed along the longitudinal direction of crossbeam 334, with each location capable of receiving a magnetic member 345. As a result, in this embodiment a single paddle A-D may contain $2^4$ or 16 bits of information relating to toner bottle 35. It is understood, however, that the number of locations on a single paddle A-D that is each capable of receiving a magnetic member 345 may be greater than or less than four. It is also understood that the locations for receiving magnetic members 335 on a paddle A-D are not limited to locations on crossbeam 334 and may include locations on arms 332. Because the distance between a location on arm 332 and a sensor(s) 47 is potentially greater than the distance between a location on crossbeam 334 and the sensor(s) 47, and assuming that the sensor(s) 47 is capable of detecting a difference in magnetic fields generated by a magnetic member 345 on crossbeam 334 and the magnetic field generated by a magnetic member 345 on an arm 332, having locations for receiving magnetic members 345 on both crossbeam 334 and arms 332 allow for the locations for receiving magnetic member 345 being along both the axial and radial directions of shaft 320 for varying the overall magnetic field generated and thereby providing even more information that can conveyed by a single paddle A-D.

Further, the number and placement of sensors 47 in image forming device 20 may vary based upon a number of factors, such as the sensitivity of sensor(s) 47, the magnetic strengths of each magnetic member 345, etc., as discussed with respect to toner bottle 35 of FIG. 3. FIG. 4 shows, in one embodiment, the use of a sensor 47 for each potential location of a magnetic member 345 and in other embodiments, the use of lesser numbers of sensors (two sensors 47*k* and one sensor 47*m*). In this embodiment, the presence or absence of a magnetic member 345 at a particular location on the paddle may indicate a logic 1 value or logic 0 value, respectively.

The embodiments discussed above may use magnets of substantially the same size and magnetic strength. Alternatively, magnets of differing sizes and/or strengths can be used. In this way, the particular placement or absence of a sensor 47 relative to magnets 340, 345 may not be critical so long as the strengths of magnets 340, 345 sufficiently vary from each other. As a result, the differing sizes/strengths of magnetic members 340, 345 provide more flexibility and more capability to read information communicated by toner bottle 35. In another alternative example embodiment, depending upon the strength of each magnetic member 340 and the sensitivity of sensor 47, it may be more feasible to use a single sensor 47*g* positioned at the center along the length of toner bottle 35 to detect magnetic members 340 without offsetting of the sensor therefrom. Similarly, a single sensor 47*m* positioned at the center along a length of crossbeam 334 may detect magnetic members 345 that have different magnetic strengths.

Figure 5:
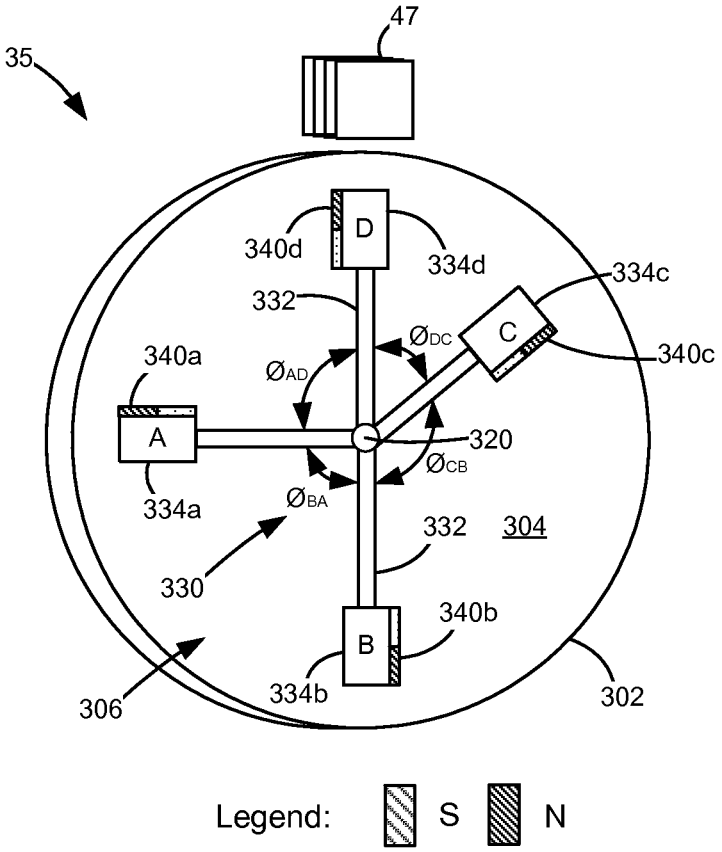
FIG. 5 is a side cross-sectional view of the sensors and replaceable unit of FIG. 3 according to another example embodiment.

FIG. 5 is a cross-sectional end view of toner bottle 35 according to another example embodiment. Whereas the angular orientation of paddles A-D in FIG. 3 are generally at 0 and 180 degrees relative to each other, in the example embodiment of FIG. 5, one or more paddles A-D may be disposed at additional angles between 0 and 360 degrees. Magnetic members 340 are angularly displaced from each other about shaft 320. In FIG. 5, paddle D (with magnetic member 340*d*) forms angle $Ø_{DC}$ with paddle C (and magnetic member 340*c*) that is about 45 degrees; paddle C forms angle $Ø_{CB}$ with paddle B (having magnetic member 340*b*) that is about 135 degrees; paddle B forms angle $Ø_{BA}$ with paddle A (having magnetic member 340*a*) that is about 90 degrees; and paddle A forms angle $Ø_{AD}$ with paddle D that is about 90 degrees. The positioning of paddles A, B, C and D corresponds to angles of about 90, 180, 315 and 0 degrees, respectively, with reference to the location of sensors 47 in FIG. 5. It is understood that, similar to the potential use of one or more sensors 47 in the embodiment of FIG. 3, a single sensor 47 may be used in the embodiment of FIG. 5 to sense the magnetic field rather than using plural sensors 47. With the locations for receiving magnetic members 340 being positionable at angular orientations other than at 0 and 180 degrees, the ability to further vary the magnetic field strength detected by sensors 47 is provided, which thereby increases the amount of information that may be maintained toner bottle 35.

In one embodiment, paddles A-D are created with a single tooled piece of plastic such that a new sequence of paddles A-D for each sequence of angular positions requires a new tooled part. In an alternative embodiment, the paddles are tooled individually and each locked into place around shaft 320. For example, paddles A-D in FIG. 5 may be tooled separately from each other to allow for varying the specific angular position for each paddle A-D, which thereby allows for varying the angular positioning of magnetic members 340*a*-340*d* mounted thereon. In yet another alternative embodiment, magnetic members 340 may include electromagnets, or movable magnets on servos.

Since the rotational speed of paddles A-D and the corresponding locations for receiving magnetic members 340 are known, the relative angles Ø between paddles A-D and therefore between locations for receiving magnetic members 340 may be easily determined by controller 26 following sampling of the magnetic field by sensors 47 (or sensor 47, if only one sensor 47 is utilized). For example, as magnetic member 340*d* passes its sensor 47 and then magnetic member 340*c* passes its sensor 47, a value of angle $Ø_{DC}$ is determined by controller 26 based on sampled readings from sensors 47. Upon determining the angular orientation of the presence or absence of magnetic members 340, controller 26 is able to determine the information regarding toner bottle 35 corresponding to the determined angular orientations. As before, the presence or absence of a magnetic member 340 at a particular (angular) position may indicate a logic 1 value or logic 0 value, respectively.

Figure 6:
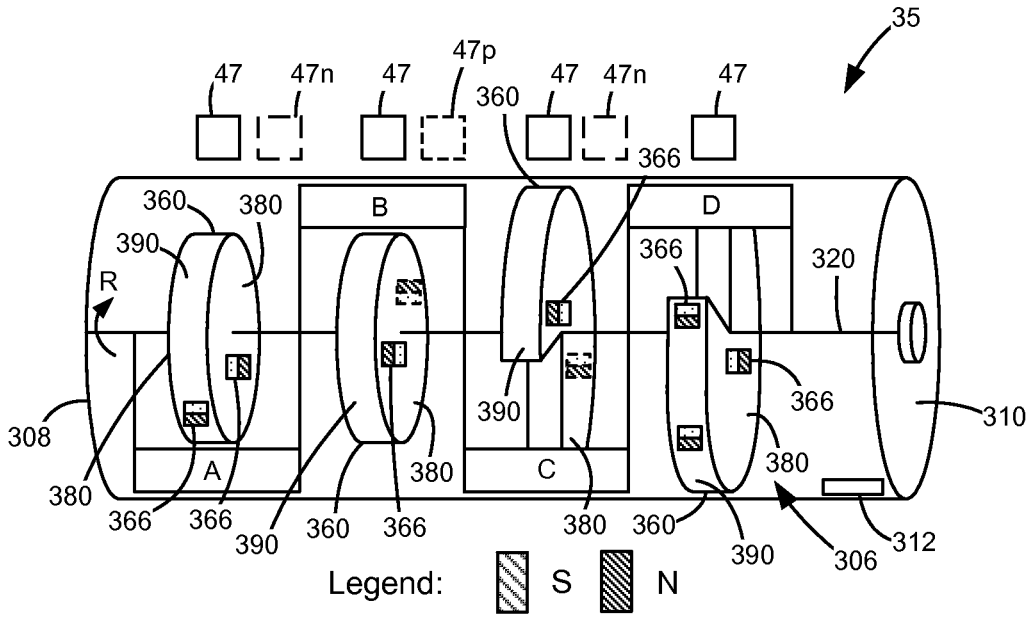
FIGS. 6 and 7 are perspective views of interior components of a replaceable unit and sensors of the image forming device of FIG. 2 according to additional example embodiments.
Figure 7:
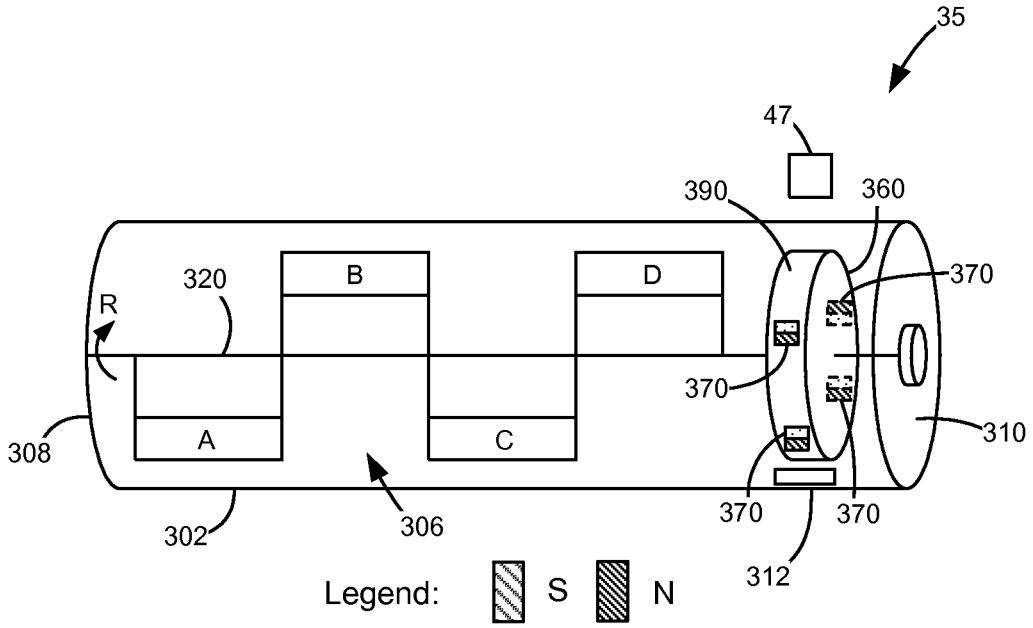

Instead of determining information based upon the relative angular displacements of paddles A-D, in another example embodiment, paddles A-D may be angularly disposed relative to a home position of shaft 320. The home position of shaft 320 may be identified using any of a number of known techniques. The home position of shaft 320 may be detected optically with, for example, shaft 320 having an encoder wheel or disk on which a mark is placed indicating the home position. The home position of shaft 320 may also be detected optically by shaft 320 with a tab that is detectable by an optical sensor. The home position of shaft 320 may be detected electromechanically by including a notch or chamfer on shaft 320 which is detectable by a spring loaded tab and sensor and/or switch. With the home position of shaft 320 known, and with the presence/absence of magnetic member(s) 340 angularly disposed or displaced from the home position, the information corresponding to the generated magnetic field is based at least in part upon the absolute angular displacement(s). FIGS. 6 and 7 are perspective views of interior components of toner bottle 35 according to two additional example embodiments. In the example embodiments illustrated, one or more disk members 360 are coupled to shaft 320 and are mounted with magnetic members 366, 370. In particular, disk members 360 are mounted on shaft 320 so as to rotate therewith in, for example, the direction R. Each disk member 360 includes opposed planar surfaces 380 and circumferential surface 390 disposed between planar surfaces 380. One or more magnetic members 366 is selectively positioned along planar surface(s) 380 and/or circumferential surface 390 of each disk member 360. Mounting magnetic members 366, 370 along circumferential surface 390 and/or along the outer portions of planar surfaces 380 result in magnetic members 366, 370 having angular displacements relative to each other and/or to a home position of shaft 320. As discussed with respect to toner bottle 35 of FIG. 5, the angular displacements of magnetic members may be used to indicate information relating to toner bottle 35. The potential locations for and potential orientations of magnetic members 366 on disk members 360, as well as the number and potential locations of disk members 360 along shaft 320, affect the magnetic field generated by magnetic members 366 and thus are used to indicate information relating to toner bottle 35. This may result in the number of bits of the digital signature of toner bottle 35 being noticeably larger than the number of bits in the digital signature of toner bottle 35 in FIG. 3. As before, the presence or absence of a magnetic member 340 at each particular (e.g., angular) position or location on a disk member 360 may indicate a logic 1 value or logic 0 value, respectively.

Disk members 360 are made of rigid plastic material to stably support magnetic members 366. Alternatively, disk members 360 may be composed of metal for greater strength and rigidity as long as the effect of metal material on magnetic fields generated by magnetic members 366, 370 is compensated for or otherwise taken into account when collecting samples of the generated magnetic field.

In order to avoid interference between disk members 360 and paddles A-D, disk members 360 may have any number of different sizes and/or shapes. In the example embodiment illustrated in FIG. 6, two different disk members 360 are illustrated. Each disk member 360 associated with paddles A and B is sized to fit within the open space of its corresponding paddle. Alternatively, disk members 360, such as disk members 360 that are associated with paddles C and D, may have substantially the same length (radius) as the length of paddles C and D. As shown, disk members 360 associated with paddles C and D each has a cutout portion in which a corresponding paddle is disposed. Both smaller sized disk members 360 associated with paddles A-B and disk members 360 having the cutout portions ensure there is little to no interference with the ability of paddles A-D to agitate and move consumable material. These substantially interference-free associations allow paddles A-D to freely agitate and direct consumable material to the outlet port 312 of toner bottle 35, and also allow magnetic members 366 to provide a magnetic field having therein information concerning toner bottle 35.

With continued reference to FIG. 6, it is understood that one or more sensors 47 may be disposed in image forming device 20 in a similar manner as described in FIG. 3 for sensing the magnetic field generated by magnetic members 366. In one embodiment, each disk member 360 may be associated with a distinct sensor 47. Alternatively, as a measure to reduce the cost of image forming device 20, the number of sensors 47 may be less than the number of disk members 366, such as one sensor 47*n* for each pair of disk members 360, and one sensor 47*p* for four disk members 360. The particular number and location of sensors 47 may be based on a number of factors including cost, the sensitivity of sensors 47, whether magnetic members 366 of varying strengths are utilized, etc.

In FIG. 7, disk member 360 is mounted on shaft 320 and positioned between paddle D and rear wall 310. Magnetic members 370 are mounted along a circumferential surface 390 of disk member 360 at different locations. It is understood that in addition or in the alternative, magnetic members 370 may be disposed along the planar surfaces of disk member 360 at different locations, such as around the outer portion thereof. The locations, on circumferential surface 390 and/or the planar surfaces of disk member 360, ensure that angular and radial displacement exists between magnetic members 370 to provide information relating to toner bottle 35 in a similar manner to that of paddles A-D being angularly displaced from each other about shaft 320 in FIG. 5. With disk member 360 positioned at a location along the length of shaft 320 at least partly spaced from paddles A-D, disk member 360 does not interfere with paddles A-D agitating consumable material and directing consumable material toward the outlet port of toner bottle 35. With this design, only a single sensor 47 is needed for detecting the magnetic field generated by magnetic members 370, though more than one sensor 47 may be used for, for example, faster and/or more accurate detection of the magnetic field.

Similar to the example embodiment of FIG. 5, the angular measurement in magnetic members 370 on disk member 360 is a relative or absolute measurement of angles, but this time, on circumferential surface 390 of disk member 360 in FIG. 7. For example, in the embodiment illustrated, samples of the magnetic field are collected as disk member 360 is rotated. Because the rotational speed of shaft 320 and thus disk member 360 is known, the presence or absence of a magnetic member 370 at particular angular displacement locations along disk member 360 can be determined by controller 26 from the collected samples and from such determination, a logic 1 value or logic 0 value may be assigned for a bit value in the digital signature for toner bottle 35. Additional locations for potentially receiving magnetic members 370 on disk member 360 (e.g. on its planar surface(s) or circumferential surface 390) can provide correspondingly more information, in the form of bit values of the digital signature, as described above.

Figure 8:
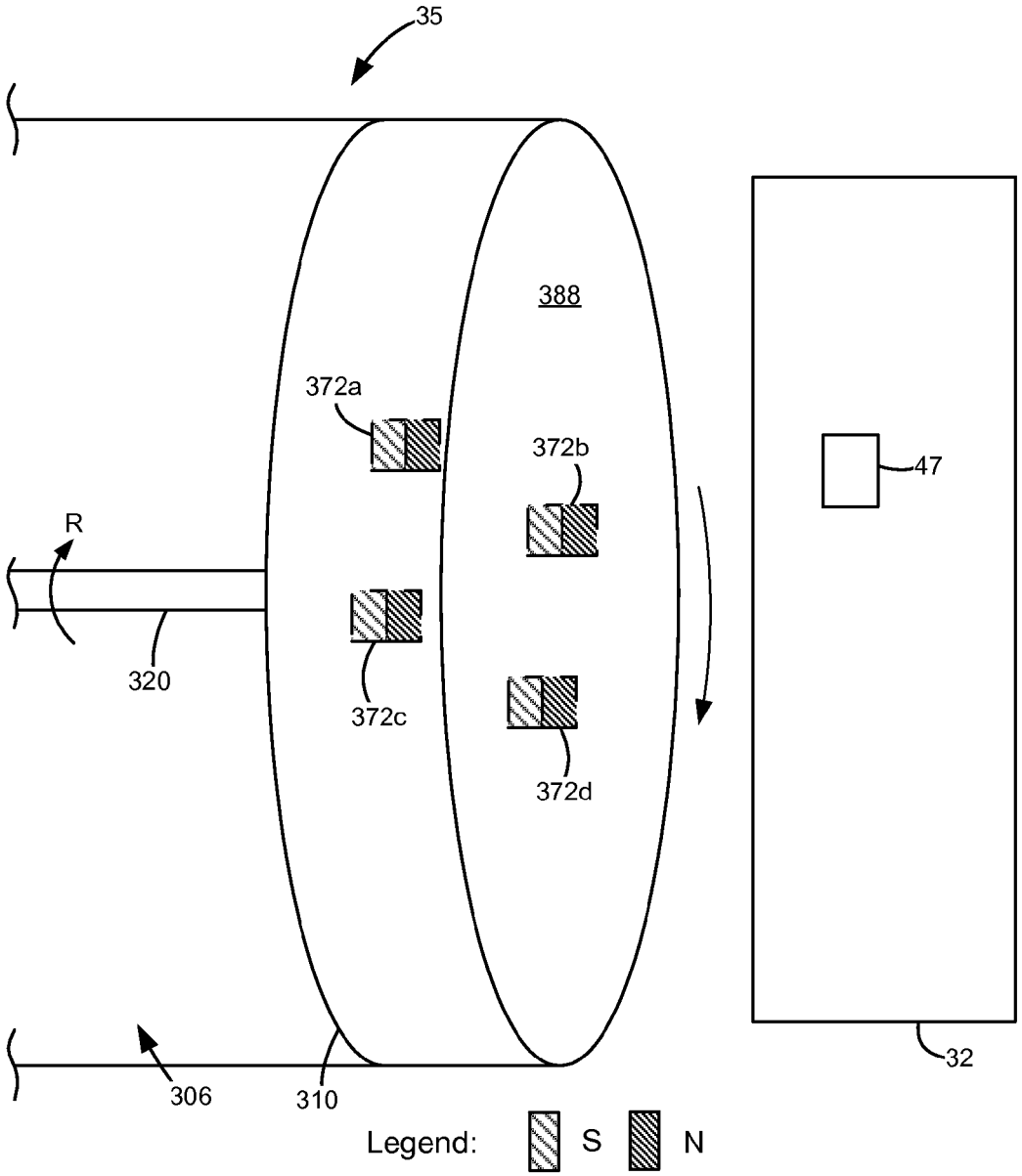
FIG. 8 is a cutaway perspective view of a replaceable unit and a sensor of the image forming device of FIG. 2 according to one example embodiment.

FIG. 8 is a cutaway perspective view of toner bottle 35 and sensor(s) 47. In this example embodiment, toner bottle 35 includes an end cap 388. End cap 388 is disposed at an end of toner bottle 35 (e.g. its rear end 310) and defines a space that is separated and/or isolated from reservoir 306 of toner bottle 35. In the example embodiment illustrated, end cap 388 has at least a portion that is rotatably coupled to shaft 320 so as to rotate therewith in, for example, the direction R. Magnetic members 372 are mounted within end cap 388 and rotate with shaft 320. In an example embodiment, end cap 388 includes a disk member 360 disposed within end cap 388 and coupled to shaft 320 for rotation therewith, with magnetic members 372 mounted to disk member 360. Magnetic members 372 may be mounted to the planar surface 380 of disk member 360 or the circumferential surface 390 thereof. For example, magnetic members 372 may be mounted to planar surface 380 of disk member 360 in a two dimensional array.

Similar to rotating magnetic members 366 and 370 in FIGS. 6-7, the presence or absence of magnetic members 372 in a particular location along disk 360 in FIG. 8 communicate information relating to toner bottle 35 to image forming device 20 via sensor(s) 47. However, in this example embodiment, one or more sensor(s) 47 are each mounted in image forming device 20 in such a way that sensor(s) 47 faces rear end 310 of toner bottle 35 when toner bottle 35 is installed in image forming device 20. The number and location of sensors 47 utilized may vary and be based upon a number of factors, as explained above.

During magnetic field measurement collecting, sensor(s) 47 detect the magnetic field from magnetic members 372 so that, based on the known rotation speed of shaft 320 and the known potential locations for magnetic members 372 in end cap 388, controller 26 is able to determine, at each potential location, the presence or absence of a magnetic member 372 thereat and with that determine the information conveyed in the magnetic field for a bit location in the digital signature for toner bottle 35, similar to previous example embodiments described above.

In another example embodiment, sensor(s) 47 are mounted on image forming device 20 to face a circumferential outer surface of end cap 388. Magnetic members 372 may be disposed within end cap 388 similar to magnetic members 366 and 370 on disk member(s) 360 in FIGS. 6 and 7, respectively, so as to directly face the sensor(s).

In the example embodiments of FIGS. 6-8, mechanical members (e.g. disk members 360 and end cap 388) for mounting and supporting magnetic members are disposed within or mounted on toner bottle 35 for rotating with a driven interior component (e.g. shaft 320). It is understood that any driven interior component rotating in toner bottle 35 may instead be used for moving the magnetic members.

In the above illustrated embodiments of FIGS. 3-7, one or more magnetic members is disposed within reservoir 306 of toner bottle 35. It is understood that magnetic ink character recognition (MICR) consumable material would be adversely affected by the presence of magnetic members in reservoir 306 of toner bottle 35 and thus magnetic members would not be placed therein. Instead, a MICR replaceable unit 35 may utilize an end cap 388 as shown in FIG. 8 that is substantially shielded from reservoir 306 so as to prevent interaction between magnetic members 372 and MICR consumable material therein. Conversely, in another embodiment, the detection of no magnets in toner bottle 35 by sensor(s) 47 may indicate that image forming device 20 is able to run in a MICR mode for printing MICR consumable material from a MICR replaceable unit.

The example embodiments have been described above in the context of a replaceable toner bottle for an electrophotographic printing device. It is understood that other embodiments may be directed to a replaceable unit for any of a number of devices, such as an inkjet printing device or a 3D printing device. The consumable material of the replaceable unit may be any flowable material, including plastic, ink, or metal powder. Such replaceable units would include a rotatable shaft as described above and, depending upon the particular architecture of the device and corresponding replaceable unit and the type of consumable material contained therein, may include a paddle assembly coupled to the rotatable shaft so as to rotate therewith.

The foregoing description of several example embodiments of the invention has been presented for purposes of illustration. It is not intended to be exhaustive or to limit the invention to the precise steps and/or forms disclosed, and many modifications and variations are possible in light of the above teaching. It is intended that the scope of the invention be defined by the claims appended hereto.

What is claimed is:

1. An apparatus for supplying consumable material, comprising:

a housing having a reservoir for storing the consumable material and an outlet for exiting the consumable material from the reservoir;

a rotatable shaft disposed inside the reservoir;

one or more magnetic members coupled to the shaft within the housing so as to rotate therewith, the one or more magnetic members generating a magnetic field and when rotating indicating information relating to the apparatus, the information being based upon a presence or absence of the one or more magnetic members relative to one or more predetermined locations for receiving a magnetic member within the housing; and one or more disk members coupled to the shaft for rotation therewith, wherein the one or more magnetic members are mounted to the one or more disk members.

2. The apparatus of claim 1, wherein the one or more magnetic members is angularly displaced about the shaft, and the information is based at least in part upon the angular displacement.

3. The apparatus of claim 1, wherein the one or more predetermined locations is disposed along a direction corresponding to a longitudinal axis of the shaft, and the information is based at least in part upon the one or more predetermined locations.

4. The apparatus of claim 1, further comprising a paddle assembly coupled to the shaft for rotation therewith, wherein the one or more predetermined locations is disposed along the one or more disk members.

5. The apparatus of claim 4, further comprising an image forming device having one or more magnetic sensors for sensing the magnetic field, and wherein the housing, the shaft, the paddle assembly, and the one or more magnetic members form at least part of a replaceable unit removably insertable into the image forming device for supplying the consumable material thereto, wherein the one or more magnetic sensors are positioned within the image forming device in a direction corresponding to a longitudinal axis of the shaft when the replaceable unit is inserted in the image forming device.

6. The apparatus of claim 1, wherein the one or more magnetic members comprises a plurality of magnetic members different from each other with respect to at least one of size and magnetic strength.

7. The apparatus of claim 1, wherein the one or more predetermined locations is angularly displaced from a predetermined location on the shaft, and the information is based at least in part upon the angular displacement.

8. The apparatus of claim 1, further comprising an end cap defining a space that is separate from the reservoir through which the shaft at least partly extends, wherein at least one of the one or more disk members is located within the end cap.

9. A replaceable unit, comprising:

a housing having a reservoir for storing consumable material and an outlet for exiting the consumable material from the reservoir;

a rotatable shaft disposed inside the reservoir and positioned along a length of the housing; and one or more magnetic members disposed within the housing and coupled to the shaft so as to rotate therewith, the one or more magnetic members generating a magnetic field and when rotating indicating information about the replaceable unit, the information being based upon a presence or absence of the one or more magnetic members relative to one or more predetermined locations for receiving a magnetic member within the housing, wherein the one or more predetermined locations comprise a plurality of redetermined locations that are disposed along at least one of a longitudinal direction, and angular direction and a radial direction relative to the shaft.

10. The replaceable unit of claim 9, further comprising a paddle assembly coupled to the shaft for rotating therewith, the paddle assembly moving the consumable material within the reservoir, wherein the one or more magnetic members is mounted to the paddle assembly.

11. The replaceable unit of claim 9, wherein the one or more magnetic members includes a plurality of magnetic members in which one of the magnetic members is different from another of the magnetic members with respect to at least one of size and magnetic strength.

12. The replaceable unit of claim 9, wherein the one or more magnetic members includes a plurality of magnetic members.

13. A replaceable unit, comprising:

a housing having a reservoir for storing consumable material and an outlet for exiting the consumable material from the reservoir;

a rotatable shaft disposed inside the reservoir and positioned along a length of the housing;

one or more magnetic members disposed within the housing and coupled to the shaft so as to rotate therewith, the one or more magnetic members generating a magnetic field and when rotating indicating information about the replaceable unit, the information being based upon a presence or absence of the one or more magnetic members relative to one or more predetermined locations for receiving a magnetic member within the housing; and one or more disk members coupled to the shaft for rotation therewith, wherein the one or more magnetic members are mounted to the one or more disk members.

14. The replaceable unit of claim 13, wherein the one or more disk members is disposed in a location separate from the reservoir.

15. The replaceable unit of claim 14, further comprising an end cap through which the shaft at least partly extends, and the one or more disk members and the one or more magnetic members are disposed within the end cap.

16. The replaceable unit of claim 13, further comprising a paddle assembly coupled to the shaft so as to rotate therewith, the one or more disk members being sized relative to the paddle assembly such that one or more paddles of the paddle assembly is disposed around the one or more disk members.

17. The replaceable unit of claim 13, further comprising a paddle assembly coupled to the shaft so as to rotate therewith, the one or more disk members including a cutout portion in which a portion of the paddle assembly is disposed.

18. An apparatus for supplying consumable material, comprising:

a housing having a reservoir for storing the consumable material and an outlet for exiting the consumable material from the reservoir;

a rotatable shaft disposed inside the reservoir; and one or more magnetic members coupled to the shaft within the housing so as to rotate therewith, the one or more magnetic members generating a magnetic field and when rotating indicating information relating to the apparatus, the information being based upon a presence or absence of the one or more magnetic members relative to one or more predetermined locations for receiving a magnetic member within the housing, wherein the one or more magnetic members comprises a plurality of magnetic members different from each other with respect to at least one of size and magnetic strength.

19. A replaceable unit, comprising:

a housing having a reservoir for storing consumable material and an outlet for exiting the consumable material from the reservoir;

a rotatable shaft disposed inside the reservoir and positioned along a length of the housing; and one or more magnetic members disposed within the housing and coupled to the shaft so as to rotate therewith, the one or more magnetic members generating a magnetic field and when rotating indicating information about the replaceable unit, the information being based upon a presence or absence of the one or more magnetic members relative to one or more predetermined locations for receiving a magnetic member within the housing, wherein the one or more magnetic members includes a plurality of magnetic members and the one or more predetermined locations comprises a plurality of predetermined locations within the housing.

20. The replaceable unit of claim 19 wherein one of the plurality of magnetic members is different from another of the plurality of magnetic members with respect to at least one of size and magnetic strength.

21. The replaceable unit of claim 19, wherein a number of the plurality of predetermined locations is greater than or equal to a number of the plurality of magnetic members.

* * * * *